US010002697B2

(12) United States Patent
Oka

(10) Patent No.: US 10,002,697 B2
(45) Date of Patent: Jun. 19, 2018

(54) SUPERCONDUCTING MAGNET DEVICE

(71) Applicant: JAPAN SUPERCONDUCTOR TECHNOLOGY INC., Kobe-shi (JP)

(72) Inventor: Atsuko Oka, Kobe (JP)

(73) Assignee: JAPAN SUPERCONDUCTOR TECHNOLOGY INC., Kobe-shi (JP)

( * ) Notice: Subject to any disclaimer, the term of this patent is extended or adjusted under 35 U.S.C. 154(b) by 0 days. days.

(21) Appl. No.: 15/466,989

(22) Filed: Mar. 23, 2017

(65) Prior Publication Data

US 2017/0287607 A1 Oct. 5, 2017

(30) Foreign Application Priority Data

Mar. 30, 2016 (JP) ..... 2016-068759

(51) Int. Cl.
*H01F 7/00* (2006.01)
*H01F 6/06* (2006.01)
*H01F 6/04* (2006.01)

(52) U.S. Cl.
CPC *H01F 6/06* (2013.01); *H01F 6/04* (2013.01)

(58) Field of Classification Search
CPC ... H01F 6/06; H01F 6/04; H01F 27/02; H01F 27/2885; H01F 27/29; G01R 33/3854; G01R 33/3815; G01R 33/20; G01V 3/00
USPC ..... 335/216
See application file for complete search history.

(56) References Cited

U.S. PATENT DOCUMENTS 4,943,781 A * 7/1990 Wilson ..... H05H 13/00 313/62
5,083,105 A * 1/1992 Herd ..... G01R 33/3815 174/15.4
5,113,165 A * 5/1992 Ackermann ..... H01F 6/04 335/216
5,613,367 A * 3/1997 Chen ..... G01R 33/3815 62/295
5,623,240 A * 4/1997 Sakuraba ..... H01F 6/065 174/15.4
5,918,470 A * 7/1999 Xu ..... F25D 19/006 335/216
5,936,499 A * 8/1999 Eckels ..... G01R 33/3804 335/216

(Continued)

FOREIGN PATENT DOCUMENTS

JP 2009-277951 11/2009

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

A superconducting magnet device includes a superconducting coil, a radiation shield, a refrigeration unit, a vacuum case, an electrode member, and a conductive member. The vacuum case includes a case body housing the superconducting coil and a surrounding cover that surrounds the refrigeration unit. The conductive member includes a contact portion having a sleeve-shaped outer circumferential face and thermally contactable with an inner face of the surrounding cover via an insulating material. The surrounding cover includes a heat radiating part including at least a surface of a portion of the surrounding cover overlapping the contact portion in a radial direction of the surrounding cover. Thermal conductivity of the heat radiating part is higher than thermal conductivity of stainless steel.

4 Claims, 6 Drawing Sheets

(56) References Cited

U.S. PATENT DOCUMENTS 6,038,867 A * 3/2000 Einziger ..... G01R 33/3815 505/892
6,107,905 A * 8/2000 Itoh ..... F17C 3/085 335/216
7,295,010 B2 * 11/2007 Fukuda ..... G01R 33/3403 324/318
7,383,688 B2 * 6/2008 van Hasselt ..... H03K 17/92 165/104.21
7,509,815 B2 * 3/2009 van Hasselt ..... H01L 39/20 335/216
7,982,566 B2 * 7/2011 Kasten ..... G01R 33/3815 324/318
8,255,023 B2 * 8/2012 Schlenga ..... H01F 6/06 324/318
8,988,176 B2 * 3/2015 Aoki ..... G01R 33/3815 324/318
2004/0239462 A1 * 12/2004 Nemoto ..... H01F 6/065 335/216
2006/0125477 A1 * 6/2006 Killoran ..... G01R 33/28 324/321
2007/0089432 A1 * 4/2007 Boesel ..... F25D 19/006 62/51.1
2007/0210795 A1 * 9/2007 Motoshiromizu . G01R 33/3802 324/318
2008/0290869 A1 * 11/2008 Hutton ..... G01R 33/30 324/318
2010/0313574 A1 * 12/2010 Koyanagi ..... F25D 19/006 62/3.1
2011/0130293 A1 * 6/2011 Kawashima ..... H01F 6/04 505/163
2011/0210729 A1 * 9/2011 Iwasa ..... G01R 33/3802 324/307
2012/0081117 A1 * 4/2012 Jiang ..... F25D 19/00 324/318
2012/0094840 A1 * 4/2012 Tanaka ..... H01F 6/006 505/211
2012/0176134 A1 * 7/2012 Jiang ..... G01R 33/3804 324/318
2012/0184444 A1 * 7/2012 Blumenthal ..... G01R 33/3854 505/162
2012/0202697 A1 * 8/2012 Calvert ..... G01R 33/3858 505/163
2014/0085021 A1 * 3/2014 Blakes ..... H01F 6/04 335/216
2014/0097920 A1 * 4/2014 Goldie ..... H01F 6/00 335/216
2014/0274724 A1 * 9/2014 Inoue ..... H01F 6/065 505/163
2016/0369946 A1 * 12/2016 Tago ..... H01F 6/04
2017/0287606 A1 * 10/2017 Miyata ..... H01F 6/04

* cited by examiner

SUPERCONDUCTING MAGNET DEVICE

TECHNICAL FIELD

The present invention relates to a superconducting magnet device.

BACKGROUND ART

A superconducting magnet device that generates a high magnetic field using a superconducting coil in a superconducting state has conventionally been known. A superconducting magnet device generally includes a superconducting coil, a vacuum case housing the superconducting coil, an electrode member attached to the vacuum case, a conductive member (e.g., a copper wire) connecting the superconducting coil to the electrode member, and a refrigeration unit, mounted on the vacuum case, for cooling the superconducting coil. In such a superconducting magnet device, the superconducting coil is cooled by a refrigerator to a very low temperature whereas the electrode member attached to the vacuum case is kept under a room temperature (about 300 K). With the electrode member connected to the superconducting coil via the conductive member such as a copper wire, cold energy of the refrigerator is transferred to the electrode member via the conductive member, which may cause frost to grow on the electrode member. A technique for solving this problem is disclosed in JP 2009-277951 A.

In the technique disclosed in JP 2009-277951 A, a portion of a copper wire connecting a superconducting coil to an electrode pin is pushed against the inner face of a vacuum case to minimize growing of frost on the electrode pin. Cold energy of a refrigerator is transferred to the vacuum case via the copper wire before reaching the electrode pin. The cold energy transferred to the vacuum case is radiated from the vacuum case, and thereby growing of frost on the electrode pin caused by excessive cooling of the electrode pin is minimized.

The superconducting magnet device disclosed in JP 2009-277951 A preferably radiates further larger amount of cold energy transferred from the vacuum case. For a vacuum case made of stainless steel, frost might grow on the outer face of the vacuum case at a location opposite the portion onto which the copper wire is pushed, forming a shape corresponding to the portion.

SUMMARY OF INVENTION

An object of the present invention is to provide a superconducting magnet device that can minimize growing of frost on both electrode member and vacuum case.

A superconducting magnet device according to one aspect of the present invention includes a superconducting coil, a radiation shield housing the superconducting coil, a refrigeration unit that cools the superconducting coil and the radiation shield, a vacuum case housing the radiation shield, an electrode member provided to the vacuum case, and a conductive member connecting the electrode member to the superconducting coil, wherein the vacuum case includes a case body housing the superconducting coil and a surrounding cover that is connected to the case body and surrounds the refrigeration unit, the conductive member includes a contact portion having a sleeve-shaped outer circumferential face and thermally contactable with an inner face of the surrounding cover via an insulating material, the surrounding cover includes a heat radiating part including at least a surface of a portion of the surrounding cover overlapping the contact portion in a radial direction of the surrounding cover, and thermal conductivity of the heat radiating part is higher than thermal conductivity of stainless steel.

DESCRIPTION OF EMBODIMENTS

A superconducting magnet device according to an embodiment of the present invention will now be described with reference to FIGS. 1 to 6.

Figure 1:
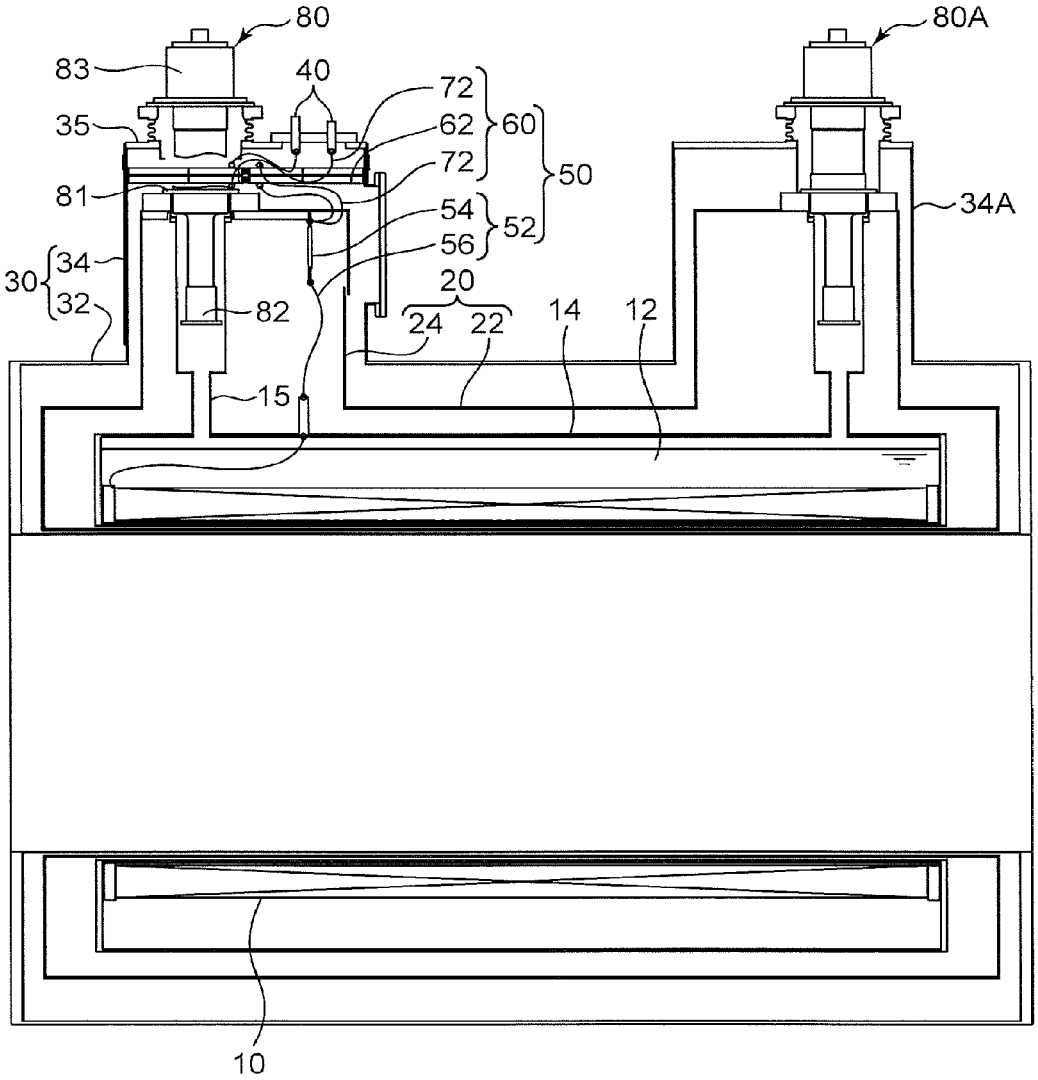
FIG. 1 is a sectional view schematically illustrating a superconducting magnet device according to an embodiment of the present invention.

As illustrated in FIG. 1, the superconducting magnet device includes a superconducting coil 10, a helium tank 14, a radiation shield 20, a vacuum case 30, an electrode member 40, a conductive member 50, and a refrigeration unit 80.

The superconducting coil 10 is formed by winding a wire made of a superconductor (superconducting material) around a frame.

The helium tank 14 houses the superconducting coil 10 and stores liquid helium 12. The helium tank 14 is made of stainless steel. A sleeve part 15 surrounding a portion of the refrigeration unit 80 is joined to the helium tank 14. Helium gas vaporized from the liquid helium 12 in the helium tank 14 condenses by being cooled by the refrigeration unit 80 in the sleeve part 15. The condensed liquid helium 12 drops into the helium tank 14.

The radiation shield 20 has a shape that covers the helium tank 14 and the sleeve part 15. The radiation shield 20 is made of aluminum. The radiation shield 20 minimizes heat transfer into the helium tank 14 from the outside of the radiation shield 20. The radiation shield 20 includes a body 22 housing the helium tank 14, and a cylinder 24 that is joined to the body 22 and surrounds the sleeve part 15.

The vacuum case 30 has a shape that covers the radiation shield 20. The inside of the vacuum case 30 is kept in a vacuum condition. This minimizes heat transfer into the vacuum case 30. The vacuum case 30 includes a case body 32, a surrounding cover 34, and a top wall 35.

The case body 32 houses the superconducting coil 10, the helium tank 14, and the body 22 of the radiation shield 20. Specifically, the case body 32 includes an inner circumferential wall and an outer circumferential wall each having a cylindrical shape. The superconducting coil 10, the helium tank 14, and the body 22 of the radiation shield 20 are housed in a space between the inner circumferential wall and the outer circumferential wall. As illustrated in FIG. 1, the superconducting coil 10, the helium tank 14, the body 22 of the radiation shield 20, and the case body 32 are disposed with their central axes kept horizontal. The case body 32 is made of stainless steel.

The surrounding cover 34 is joined to the case body 32 and surrounds a portion of the refrigeration unit 80. The surrounding cover 34 of the embodiment has a cylindrical shape. The surrounding cover 34 will be described in detail later.

The top wall 35 is attached to the top end of the surrounding cover 34. The electrode member 40 and the refrigeration unit 80 are attached to the top wall 35.

The refrigeration unit 80 can detachably be connected to the vacuum case 30 (the top wall 35 of the embodiment). The refrigeration unit 80 includes a first cooling stage 81 and a second cooling stage 82.

The first cooling stage 81 is connected to the radiation shield 20. The second cooling stage 82 is disposed inside the sleeve part 15 extending upward from the helium tank 14. By driving a driving unit 83 of the refrigeration unit 80, the temperature of the first cooling stage 81 becomes 30 K to 60 K and the temperature of the second cooling stage 82 becomes about 4 K. In the embodiment, by driving the driving unit 83, the radiation shield 20 is cooled to a temperature of about 40 K to 90 K and the helium gas evaporated from the liquid helium 12 in the helium tank 14 condenses by being cooled by the second cooling stage 82.

In the embodiment, another surrounding cover 34A is joined to the case body 32, and another refrigeration unit 80A is connected to a top wall attached to the surrounding cover 34A. The refrigeration unit 80A is configured almost as the same as the refrigeration unit 80, and thus the description is omitted.

The conductive member 50 connects the superconducting coil 10 to the electrode member 40. Specifically, the conductive member 50 includes a low temperature conductor 52 that connects the superconducting coil 10 to the radiation shield 20, and a high temperature conductor 60 that connects the radiation shield 20 to the electrode member 40.

The low temperature conductor 52 includes an oxidized lead 54. The oxidized lead 54 is a conductor that conducts electricity from the electrode member 40 to the superconducting coil 10 while minimizing heat transfer into the superconducting coil 10 from the outside. The oxidized lead 54 is connected to a member having a temperature of the same level as the first cooling stage 81. In the embodiment, the oxidized lead 54 is connected to a plate fixed to the first cooling stage 81. The oxidized lead 54 is connected to the superconducting coil 10 via a copper wire 56.

Figure 4:
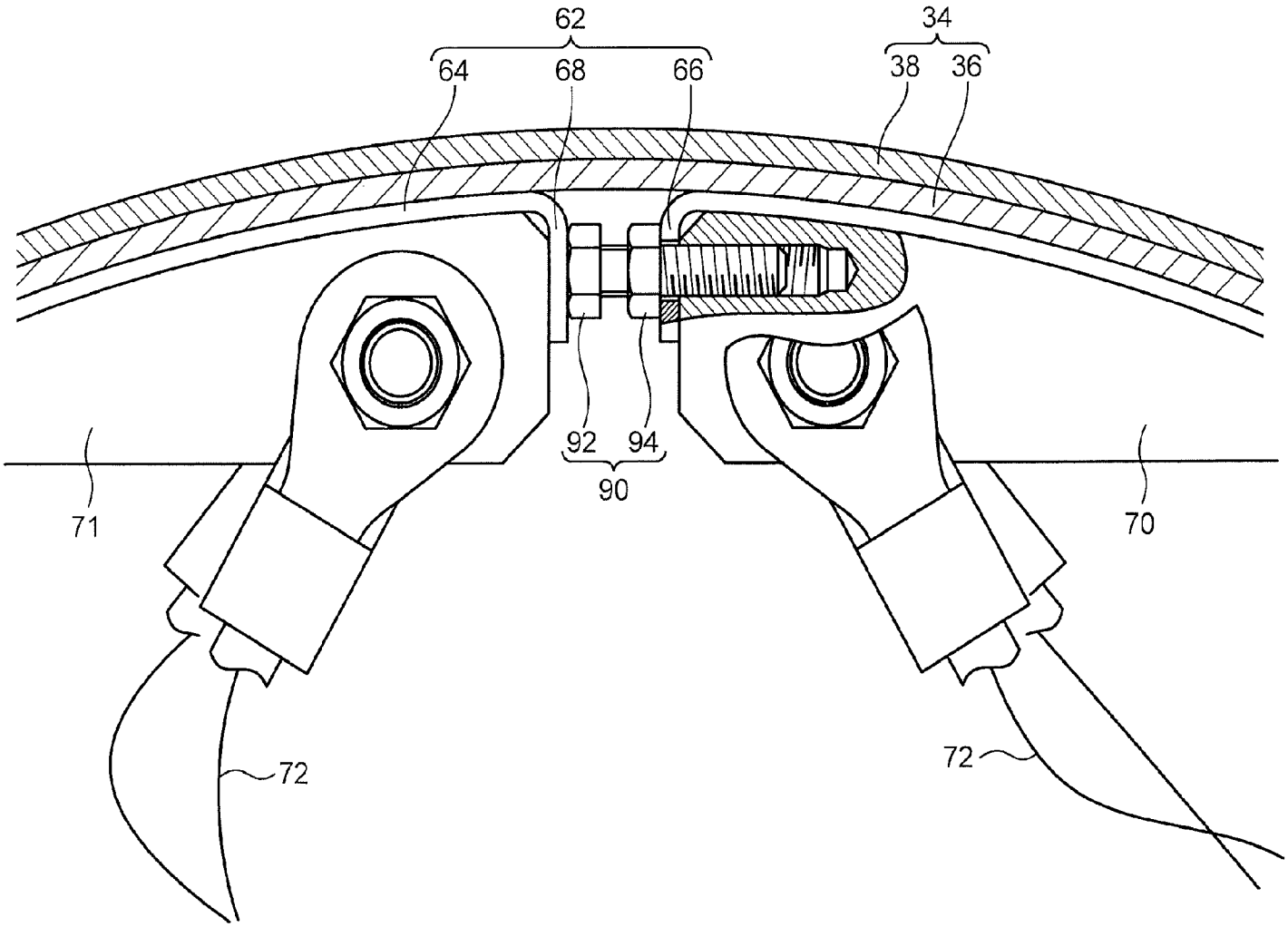
FIG. 4 is an enlarged view illustrating a region around a pushing portion.
Figure 5:
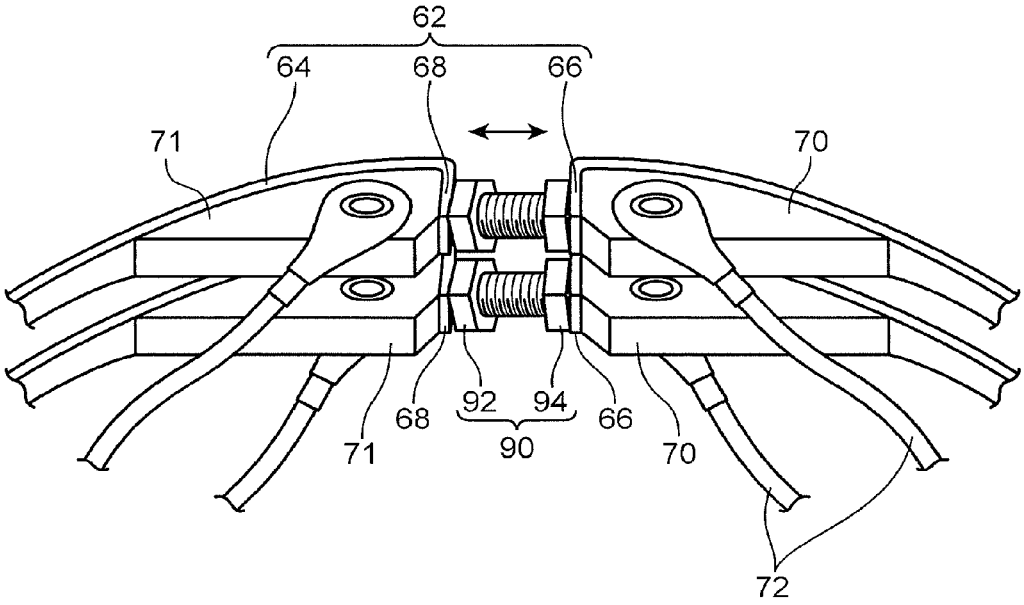
FIG. 5 is a perspective view illustrating a region around the pushing portion.

The high temperature conductor 60 includes a contact portion 62 that is in contact with the inner face of the surrounding cover 34. The contact portion 62 has a sleeve-shaped outer circumferential face and is in thermal contact with the inner face of the surrounding cover 34 via an insulating material (not shown). A copper busbar is used as the contact portion 62 in the embodiment. An end of the contact portion 62 is connected to the electrode member 40 via a copper wire 72, and the other end of the contact portion 62 is connected to the oxidized lead 54 via the copper wire 72. Specifically, the contact portion 62 includes a positive contact portion provided between the positive terminal of the electrode member 40 and the oxidized lead 54 and a negative contact portion provided between the negative terminal of the electrode member 40 and the oxidized lead 54. The positive contact portion and the negative contact portion have the same structure. Thus, only one of the contact portions will be described below. As illustrated in FIGS. 4 and 5, the contact portion 62 includes a contact portion body 64, a first opposing portion 66, and a second opposing portion 68.

The contact portion body 64 has a shape extending along the inner face of the surrounding cover 34 in the circumferential direction of the surrounding cover 34. That is, the contact portion body 64 of the embodiment has a cylindrical outer circumferential face. The contact portion body 64 is in thermal contact with the inner circumferential face of the surrounding cover 34 via the insulating material.

Figure 2:
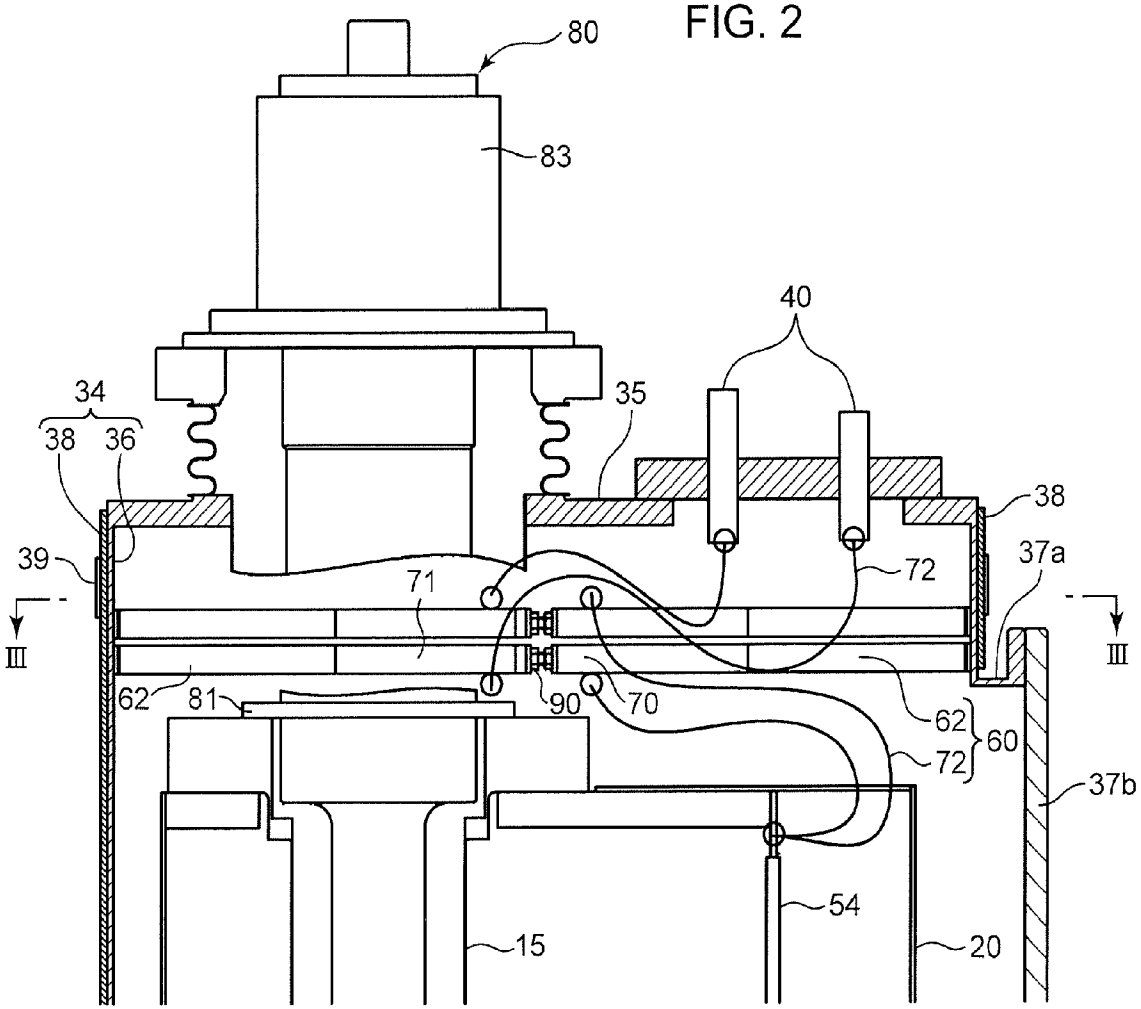
FIG. 2 is an enlarged view illustrating a region around a contact portion illustrated in FIG. 1.
Figure 3:
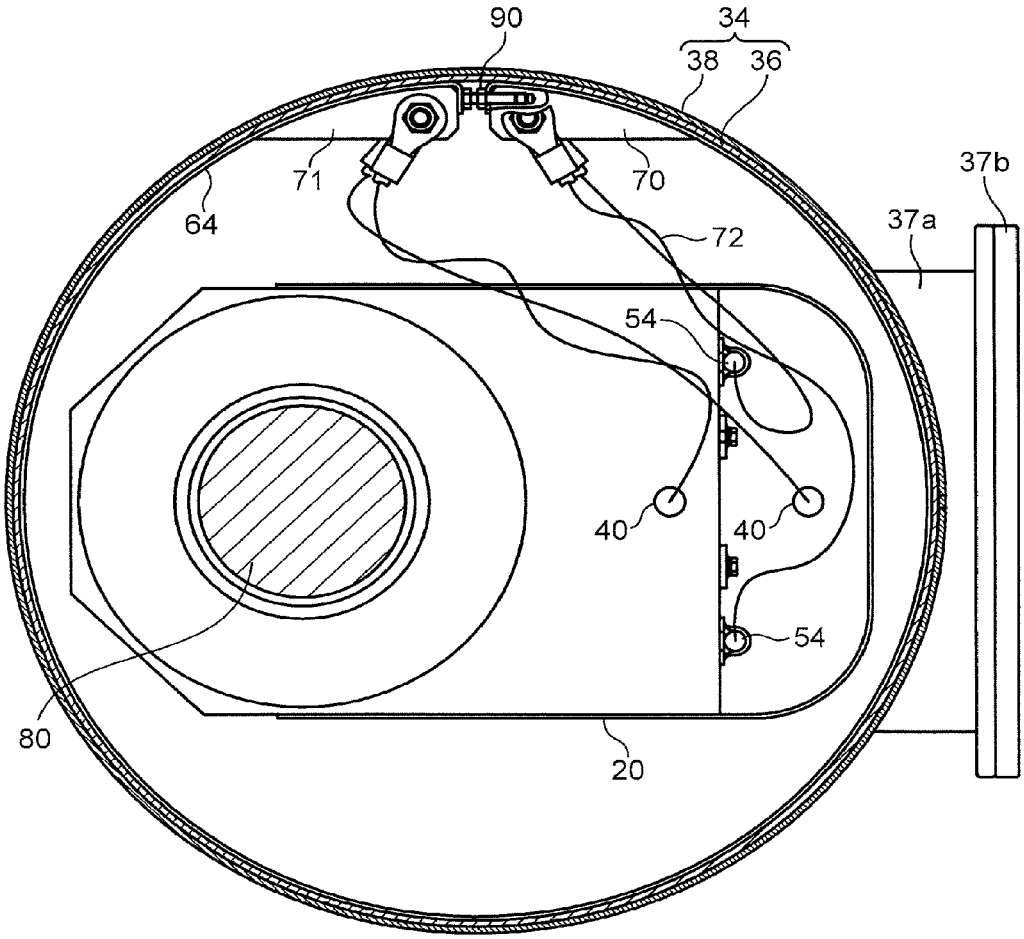
FIG. 3 is a sectional view taken along line in FIG. 2.

The first opposing portion 66 is connected to an end of the contact portion body 64. The first opposing portion 66 has a shape extending from one of the ends of the contact portion body 64 inward in the radial direction of the contact portion body 64. A first base 70 to which the copper wire 72 is attached is fixed (welded) in the corner between the first opposing portion 66 and the contact portion body 64. As illustrated in FIGS. 2 and 3, the copper wire 72 connected to the first base 70 is connected to the oxidized lead 54.

The second opposing portion 68 is connected to the other end of the contact portion body 64. The second opposing portion 68 opposes the first opposing portion 66 in the circumferential direction of the contact portion body 64. The second opposing portion 68 has a shape extending from the other end of the contact portion body 64 inward in the radial direction of the contact portion body 64. A second base 71 to which the copper wire 72 is attached is fixed (welded) in the corner between the second opposing portion 68 and the contact portion body 64. As illustrated in FIGS. 2 and 3, the copper wire 72 connected to the second base 71 is connected to the electrode member 40.

The superconducting magnet device according to the embodiment further includes a pushing portion 90. The pushing portion 90 pushes the contact portion body 64 onto the surrounding cover 34 such that the outer face of the contact portion body 64 is in close contact with the inner face of the surrounding cover 34 via the insulating material. Specifically, the pushing portion 90 pushes the second opposing portion 68 in a direction away from the first opposing portion 66 to separate from each other in the circumferential direction (so as to increase the diameter of the contact portion body 64), whereby pushing the contact portion body 64 against the surrounding cover 34. The thermal conductivity of the pushing portion 90 is lower than the thermal conductivity of the contact portion 62. Thus, most of the cold energy transferred from the superconducting coil 10 to the electrode member 40 passes through the contact portion 62 instead of the pushing portion 90. The pushing portion 90 of the embodiment is made of resin.

The pushing portion 90 includes a bolt 92 and a nut 94. The first opposing portion 66 is provided with a through hole that permits insertion of the shaft of the bolt 92, and the first base 70 is provided with a recess that can accommodate the shaft. As illustrated in FIGS. 4 and 5, the nut 94 is attached to the shaft with the shaft of the bolt 92 inserted in the through hole and the recess and the head of the bolt 92 in contact with the second opposing portion 68. The nut 94 locks the relative position of the head of the bolt 92 to the first opposing portion 66, where the head of the bolt 92 is pushed onto the second opposing portion 68 (locking the bolt 92 not to come loose). By rotating the bolt 92 relative to the nut 94, the distance between the first opposing portion 66 and the second opposing portion 68 is changed. For example, by rotating the bolt 92 to increase the distance between the first opposing portion 66 and the second opposing portion 68, the contact pressure of the contact portion body 64 to the surrounding cover 34 increases (thereby providing a firmer thermal contact between the contact portion body 64 and the surrounding cover 34).

The surrounding cover 34 will now be described. The surrounding cover 34 includes a sleeve part 36 and a heat radiating part 38.

The sleeve part 36 is joined to the case body 32 with the central axis of the sleeve part 36 kept perpendicular to the central axis of the case body 32. The sleeve part 36 is made of stainless steel. In the embodiment, a joint sleeve 37*a* and a lid 37*b* are joined to the sleeve part 36. The joint sleeve 37*a* is joined to the lateral portion of the sleeve part 36. The lid 37*b* is detachably attached to the joint sleeve 37*a*.

Figure 6:
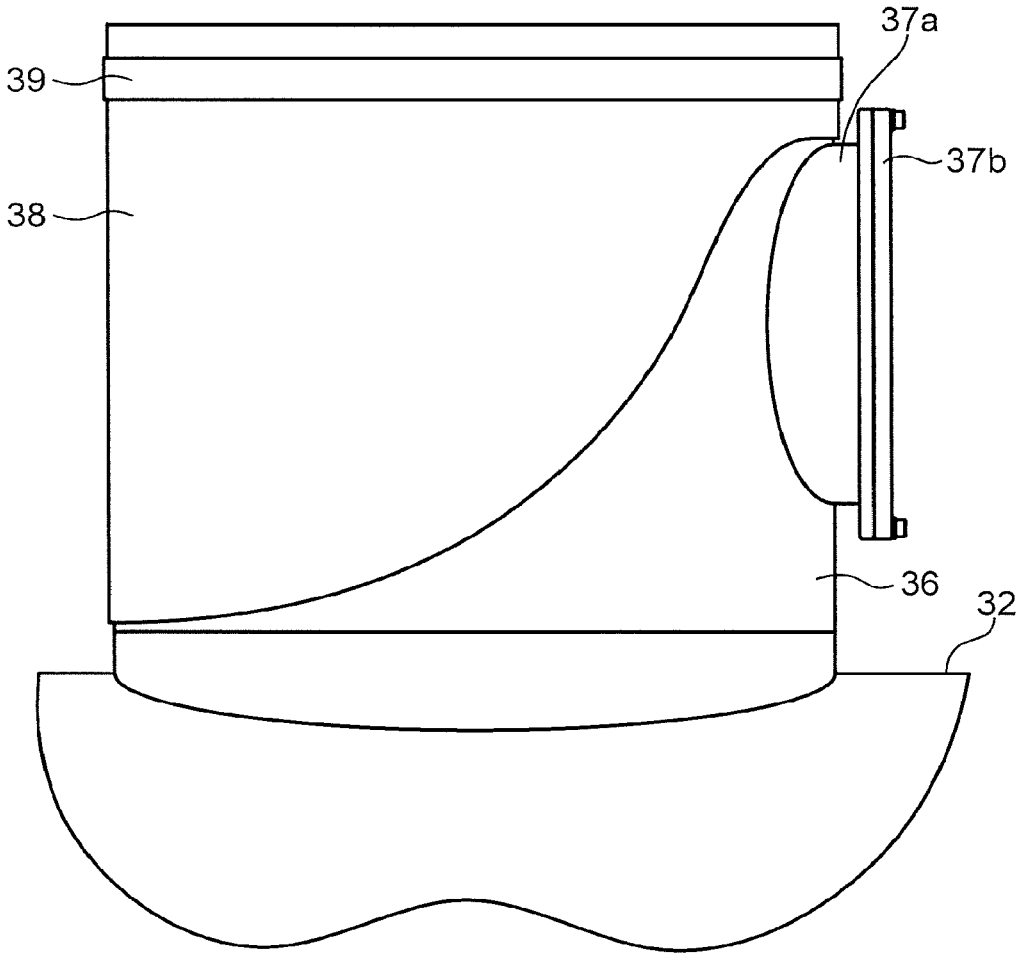
FIG. 6 is a side view illustrating a surrounding cover.

The heat radiating part 38 is fixed to the sleeve part 36. The thermal conductivity of the heat radiating part 38 is higher than the thermal conductivity of the sleeve part 36 (thermal conductivity of stainless steel). In the embodiment, the heat radiating part 38 is made of aluminum. The heat radiating part 38 covers at least the surface of the portion of the sleeve part 36 overlapping the contact portion 62 in the radial direction of the sleeve part 36. In the embodiment as illustrated in FIGS. 2 and 6, the heat radiating part 38 has a shape covering half or more of the region of the outer circumferential face of the sleeve part 36 (the shape circumferentially continuous in the circumferential direction of the sleeve part 36 but detouring the joint sleeve 37*a*). The area of the heat radiating part 38 is preferably ten times or more of the surface area of the portion of the sleeve part 36 overlapping the contact portion 62. The heat radiating part 38 is fixed by a band 39 to the sleeve part 36 such that the inner circumferential face of the heat radiating part 38 is in close contact with the outer circumferential face of the sleeve part 36.

As described above, the superconducting magnet device according to the embodiment allows the cold energy to be surely transferred from the conductive member 50 to the surrounding cover 34 of the vacuum case 30 while the device being operated, and moreover, the cold energy is effectively radiated from the heat radiating part 38 to minimize growing of frost on both the electrode member 40 and vacuum case 30. Specifically, the contact portion 62 having a sleeve-shaped outer circumferential face is in thermal surface contact or approximate thermal surface contact with the inner face of the surrounding cover 34, which allows cold energy to be surely transferred from the contact portion 62 to the surrounding cover 34. In other words, the amount of cold energy transferred from the conductive member 50 to the electrode member 40 is reduced. Thus, growing of frost on the electrode member 40 is minimized. Note that, the insulating material cuts off the electric contact between the surrounding cover 34 and the contact portion 62. Since the thermal conductivity of the heat radiating part 38 is higher than the thermal conductivity of stainless steel, the cold energy transferred from the refrigeration unit 80 to the surrounding cover 34 via the superconducting coil 10 and the contact portion 62 is effectively radiated from the heat radiating part 38. Thus, growing of frost on the surrounding cover 34 is also minimized.

The superconducting magnet device includes the pushing portion 90 that pushes the contact portion 62 onto the inner face of the surrounding cover 34. This raises the contact pressure of the contact portion 62 to the inner face of the surrounding cover 34, namely, provides a firmer thermal contact between the contact portion 62 and the surrounding cover 34, and thereby the cold energy is further surely transferred from the contact portion 62 to the surrounding cover 34.

More specifically, the pushing portion 90 pushes the second opposing portion 68 against the first opposing portion 66 to separate from each other, whereby pushing the contact portion body 64 against the inner face of the surrounding cover 34. In this embodiment, in which the contact portion body 64 is forced to deform outward by the pushing portion 90 pushing the opposing portions 66 and 68, a firmer thermal contact between the contact portion body 64 and the surrounding cover 34 is created more easily than directly pushing the contact portion body 64 onto the surrounding cover 34.

Since the thermal conductivity of the pushing portion 90 is lower than the thermal conductivity of the contact portion 62, most of the cold energy transferred from the superconducting coil 10 to the electrode member 40 passes through the contact portion body 64 instead of the pushing portion 90. Thus, cold energy is effectively and surely transferred from the contact portion 62 to the surrounding cover 34.

Note that, the presently disclosed embodiment is to be considered in all respects to be illustrative and not restricted. The scope of the present invention is described by the claims, not by the embodiment. Any modification made within the meaning and the scope of the doctrine of equivalents to the scope of the claims all falls within the scope of the present invention.

For example, the liquid helium 12 and the helium tank 14 may be omitted. In such a case, the superconducting coil 10 is cooled by the refrigeration unit 80 via a plate joined to the second cooling stage 82 of the refrigeration unit 80.

The sleeve part 36 may be made of aluminum. In this case, the sleeve part 36 and the heat radiating part 38 are preferably integrated.

The sleeve part 36 needs not have a cylindrical shape. The sleeve part 36 may have a shape of a polygonal sleeve. In this case, the contact portion body 64 has a shape that fits with the inner circumferential face of the sleeve part 36.

The pushing portion 90 does not necessarily include the bolt 92 and the nut 94 and may include any member that can push the second opposing portion 68 in a direction away from the first opposing portion 66 to separate from each other in the circumferential direction of the sleeve part 36. For example, the pushing portion 90 may include an elastic member that can push the second opposing portion 68 against the first opposing portion 66 to separate from each other and has thermal conductivity lower than the thermal conductivity of the contact portion 62. However, the force pushing the contact portion body 64 onto the surrounding cover 34 can be adjusted easily by using the bolt 92 and the nut 94 as the pushing portion 90 as in the embodiment described above.

The embodiment described above includes the following invention.

A superconducting magnet device according to the embodiment includes a superconducting coil, a radiation shield housing the superconducting coil, a refrigeration unit that cools the superconducting coil and the radiation shield, a vacuum case housing the radiation shield, an electrode member provided to the vacuum case, and a conductive member connecting the electrode member to the superconducting coil. The vacuum case includes a case body housing the superconducting coil and a surrounding cover that is connected to the case body and surrounds the refrigeration unit. The conductive member includes a contact portion having a sleeve-shaped outer circumferential face and thermally contactable with an inner face of the surrounding cover via an insulating material. The surrounding cover includes a heat radiating part including at least a surface of a portion of the surrounding cover overlapping the contact portion in a radial direction of the surrounding cover. Thermal conductivity of the heat radiating part is higher than thermal conductivity of stainless steel.

The superconducting magnet device allows cold energy to be surely transferred from the conductive member to the surrounding cover of the vacuum case, and moreover, the cold energy is effectively radiated from the heat radiating part to minimize growing of frost on both the electrode member and vacuum case. Specifically, the contact portion having a sleeve-shaped outer circumferential face is in thermal surface contact or approximate thermal surface contact with the inner face of the surrounding cover, which allows cold energy to be surely transferred from the contact portion to the surrounding cover. In other words, the amount of cold energy transferred from the conductive member to the electrode member is reduced. Thus, growing of frost on the electrode member is minimized. Note that, the insulating material cuts off the electric contact between the surrounding cover and the contact portion. Since the thermal conductivity of the heat radiating part is higher than the thermal conductivity of stainless steel, the cold energy transferred from the refrigeration unit to the surrounding cover via the superconducting coil and the contact portion is effectively radiated from the heat radiating part. Thus, growing of frost on the surrounding cover is also minimized.

It is preferable in this case to further include a pushing portion that pushes the contact portion onto the surrounding cover such that the contact portion is in close contact with the inner face of the surrounding cover via the insulating material.

This raises the contact pressure of the contact portion to the inner face of the surrounding cover, namely, provides a firmer thermal contact between the contact portion and the surrounding cover, and thereby the cold energy is further surely transferred from the contact portion to the surrounding cover.

Furthermore in this case, it is preferable that the contact portion includes a contact portion body having a shape extending along an inner face of the surrounding cover in a circumferential direction of the surrounding cover, a first opposing portion connected to an end of the contact portion body, and a second opposing portion that is connected to another end of the contact portion body and opposes the first opposing portion in the circumferential direction, wherein the pushing portion pushes the second opposing portion in a direction away from the first opposing portion to separate from each other in the circumferential direction, whereby pushing the contact portion body against the surrounding cover, and thermal conductivity of the pushing portion is lower than thermal conductivity of the contact portion.

In this embodiment, in which the contact portion body is forced to deform outward by the pushing portion pushing the opposing portions, a firmer thermal contact between the contact portion body and the surrounding cover is created more easily than directly pushing the contact portion body onto the surrounding cover. Since the thermal conductivity of the pushing portion is lower than that of the contact portion, most of the cold energy transferred from the superconducting coil to the electrode member passes through the contact portion body instead of the pushing portion. Thus, cold energy is effectively and surely transferred from the contact portion to the surrounding cover.

In the superconducting magnet device, it is preferable that the surrounding cover further includes a sleeve part having a sleeve shape, connected to the case body, and made of stainless steel, and the heat radiating part is made of aluminum and has a shape covering at least an outer face of a portion of the sleeve part overlapping the contact portion in an radial direction of the sleeve part.

In this manner, the cold energy transferred to the sleeve part made of stainless steel via the contact portion is effectively radiated via the heat radiating part made of aluminum, which has a higher thermal conductivity than that of stainless steel.

This application is based on Japanese Patent application No. 2016-068759 filed in Japan Patent Office on Mar. 30, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A superconducting magnet device comprising:
a superconducting coil;
a radiation shield housing the superconducting coil;
a refrigeration unit that cools the superconducting coil and the radiation shield;
a vacuum case housing the radiation shield;
an electrode member provided to the vacuum case; and
a conductive member connecting the electrode member to the superconducting coil,
wherein
the vacuum case includes
a case body housing the superconducting coil, and
a surrounding cover that is connected to the case body and surrounds the refrigeration unit,
the conductive member includes a contact portion having a sleeve-shaped outer circumferential face and thermally contactable with an inner face of the surrounding cover via an insulating material,
the surrounding cover includes a heat radiating part including at least a surface of a portion of the surrounding cover overlapping the contact portion in a radial direction of the surrounding cover, and
thermal conductivity of the heat radiating part is higher than thermal conductivity of stainless steel.

2. The superconducting magnet device according to claim 1, further comprising
a pushing portion that pushes the contact portion onto the surrounding cover such that the contact portion is in close contact with the inner face of the surrounding cover via the insulating material.

3. The superconducting magnet device according to claim 2, wherein
the contact portion includes
a contact portion body having a shape extending along an inner face of the surrounding cover in a circumferential direction of the surrounding cover,
a first opposing portion connected to an end of the contact portion body, and
a second opposing portion that is connected to another end of the contact portion body and opposes the first opposing portion in the circumferential direction,
the pushing portion pushes the second opposing portion in a direction away from the first opposing portion to separate from each other in the circumferential direction, whereby pushing the contact portion body against the surrounding cover, and
thermal conductivity of the pushing portion is lower than thermal conductivity of the contact portion.

4. The superconducting magnet device according to claim 1, wherein the surrounding cover further includes a sleeve part having a sleeve shape, connected to the case body, and made of stainless steel, and the heat radiating part is made of aluminum and has a shape covering at least an outer face of a portion of the sleeve part overlapping the contact portion in an radial direction of the sleeve part.

* * * * *